United States Patent [19]

Ferchau et al.

[11] Patent Number: 4,911,647

[45] Date of Patent: Mar. 27, 1990

[54] INSERTION/EXTRACTION MECHANISM FOR BLIND PLUGGABLE MODULES

[75] Inventors: Joerg U. Ferchau, Morgan Hill; Hugh M. Davis, Jr., Gilroy; Christopher A. Hunt, San Jose, all of Calif.

[73] Assignee: Tandem Computers Incorporated, Cupertino, Calif.

[21] Appl. No.: 295,333

[22] Filed: Jan. 10, 1989

[51] Int. Cl.[4] ..... H01R 13/62

[52] U.S. Cl. ..... 439/157; 439/476; 439/372

[58] Field of Search ..... 439/152, 153, 157, 159, 439/160, 266, 297, 298, 372, 484, 476

[56] References Cited

U.S. PATENT DOCUMENTS

| | | | |
|---|---|---|---|
| 2,714,195 | 7/1955 | Beatty . | |
| 2,955,273 | 10/1960 | Winkler . | |
| 3,035,243 | 5/1962 | Bowling | 439/160 |
| 3,052,863 | 9/1962 | Uberbacher . | |
| 3,724,322 | 4/1973 | Reed . | |
| 3,801,757 | 4/1974 | Carissimi . | |

FOREIGN PATENT DOCUMENTS

| | | | |
|---|---|---|---|
| 687866 | 2/1940 | Fed. Rep. of Germany . | |
| 1299744 | 7/1969 | Fed. Rep. of Germany . | |
| 2240450 | 10/1973 | Fed. Rep. of Germany | 439/372 |
| 2071928 | 9/1981 | United Kingdom | 439/372 |
| 2118786 | 11/1983 | United Kingdom . | |

*Primary Examiner*—David Pirlot

*Attorney, Agent, or Firm*—Townsend and Townsend

[57] ABSTRACT

An insertion/extraction mechanism is used to cause blind mateable electrical connectors on an electrical module to engage and disengage mating electrical connectors in a housing by forcing the module to and from its fully inserted position within the housing. The mechanism includes a U-shaped handle pivotally mounted to the module at its ends through elastomeric sleeves. The sleeves are each mounted in a mounting hole in the module and each has a central bore within which a mounting shaft, extending from the handle, is housed. Each end of the handle has a camming surface which engages a pivot pin carried by the housing as the handle is pivoted while inserting the module into and withdrawing the module from the housing. This engagement of the camming surfaces and the pivot pins causes the handle ends and the associated mounting shafts to push radially against the elastomeric sleeves as the handle is pivoted during insertion and extraction. The elastomeric sleeves both support the mounting shafts and provide the desired biasing force to help keep the module fully inserted within the housing.

6 Claims, 3 Drawing Sheets

INSERTION/EXTRACTION MECHANISM FOR BLIND PLUGGABLE MODULES

BACKGROUND OF THE INVENTION

This invention relates to insertion/extraction mechanisms for electronic modules. In particular, this invention relates to insertion/extraction mechanisms for blind pluggable modules which cause electrical connectors to engage and disengage by forcing the module to and from its fully inserted position within the housing.

Locking mechanisms for electronic modules have heretofore addressed problems such as plugging multiple pins into multiple sockets, quick release mechanisms for hazardous applications, and various self-releasing mechanisms which release upon the action of a missile. See generally U.S. Pat. No. 3,052,863, Uberbacher and Evans, "Improved Multiple Contact Connector", issued Sept. 4, 1962; Carissimi et al. U.S. Pat. No. 3,801,757 for "Heavy Duty Connector", issued Apr. 2, 1974; and Reed, "Retractable Electrical Connector for Missiles", U.S. Pat. No. 3,724,322, issued Apr. 3, 1973. Other inventors have solved the problem of locking electronic modules into housing using externally applied biasing via springs attached to levers. See for example Patentschrift 687,866, issued to Gebbert and Schildbach, Feb. 7, 1940, and Auslegescrift 1,299,744 issued to Fritz Hellige & Co. G.m.b.H., July 24, 1969. As seen from these references, previous methods of locking electronic modules often utilize external springs and auxiliary hardware to exert the desired locking bias which increase the complexity and cost of the system.

SUMMARY OF THE INVENTION

The invention is directed to an insertion/extraction apparatus particularly useful for inserting electronic modules into a housing, locking the module in place and extracting the module from the housing, The apparatus includes a handle having a gripping portion, which the user grasps, and an attachment portion. The attachment portion of the handle is pivotally connected to the electronic module by a pivot mount. The pivot mount includes a radially elastic member, typically an elastomeric sleeve, which is mounted within a mounting hole formed in the module. The pivot mount also includes a support shaft extending into a central bore formed in the radially elastic member, and thus through the mounting hole in the module, so to secure the handle to the module.

The attachment portion of the handle, in the preferred embodiment, includes a latching surface. The latching surface engages a pivot post extending from the housing into the interior of the housing. The latching surface and pivot post form a cam lock when the module is inserted into the housing. During the last portion of movement of the module into the housing, the latching surface passes over the center of the mounting hole as the handle is pivoted from its withdrawn position to its locked position. Doing so causes the pivot post to radially bias the support shaft against the elastomeric sleeve. The amount of deflection is the greatest at an intermediate portion along the travel of the handle. The elastomeric sleeve is preferably deflected somewhat even when the handle is in the locked rotary position. This creates a biasing force on the module urging the module into the housing which helps to keep the module in place within the housing even during shipping.

The radially elastic member, through which a shaft passes, both pivotally supports the shaft and radially biases the shaft to achieve a simple but effective locking structure. The need for additional external hardware is thus avoided.

Another advantage of the invention is that the radially elastic member accommodates a certain amount of tolerance build-up between the module and housing, especially relative to any blind matable connectors which may be used.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
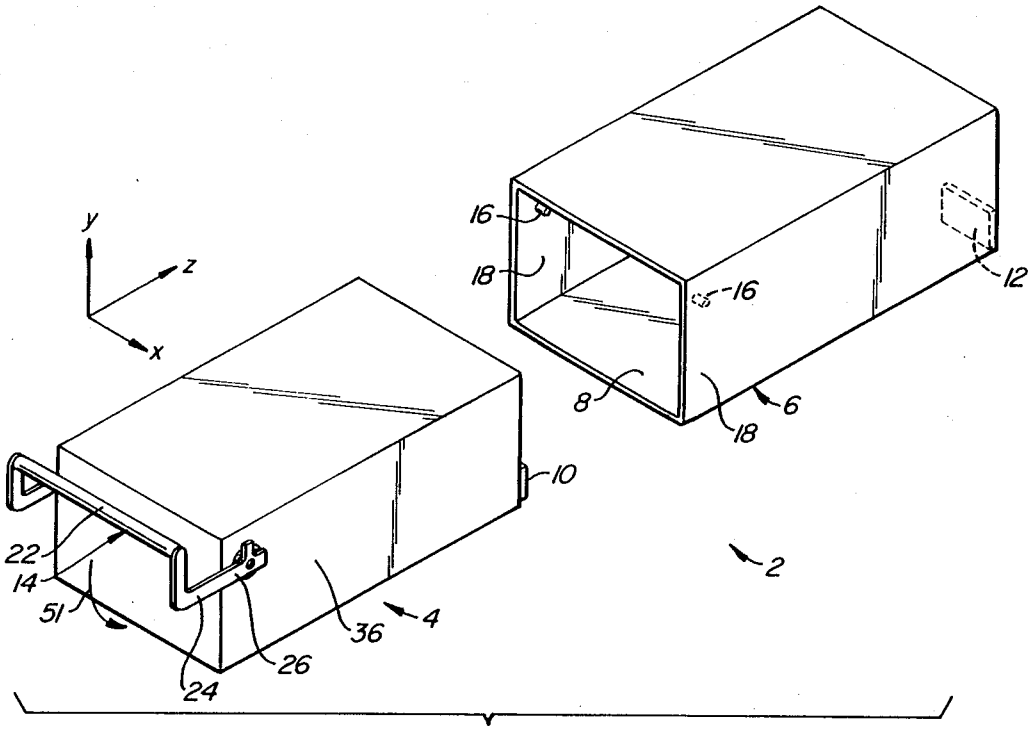
FIG. 1 is an exploded simplified isometric view showing the insertion/retraction apparatus of the invention in an exploded view.

Referring now to FIG. 1, an insertion/extraction apparatus 2 is shown with a simplified representation of an electronic module 4 and a housing 6. Housing 6 defines an interior B within which module 4 is mounted. Module 4 and housing 6 include conventional connectors 10, 12 which engage once module 4 is fully inserted within interior 8 of housing 6.

Apparatus 2 includes a handle 14 pivotally mounted to module 4 and a pair of pivot posts 16 mounted to the side walls 18 of housing 6 and extending into interior 8. Handle 14 includes a gripping portion 22 and legs 24. The distal ends of legs 24 include attachment portions 26 which engage pivot post 16 during insertion and removal of module 4 into and from interior 8 of housing 6 as discussed in more detail below.

Figure 2:
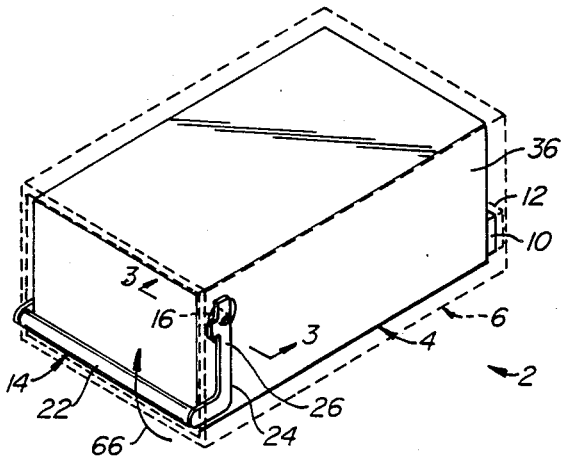
FIG. 2 is an isometric view of the apparatus of FIG. 1 shown assembled with the electronic module in solid lines and the housing in dashed lines.
Figure 3:
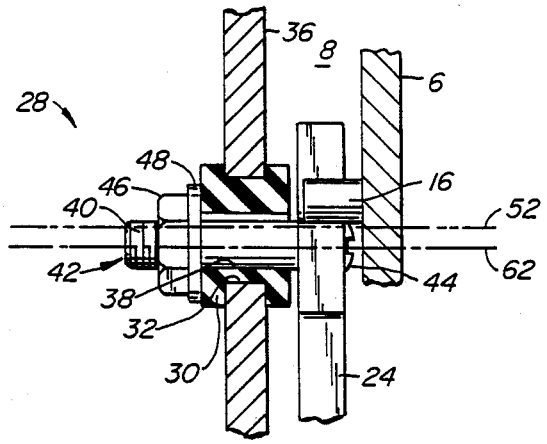
FIG. 3 is a partial cross-sectional view taken along line 3—3 of FIG. 2.

Referring now also to FIGS. 2–3, apparatus 2 is seen to include a pivot mount 28 at each attachment portion 26. Each pivot mount 28 includes an elastomeric sleeve 30 mounted within a mounting hole 32 formed in both of the side walls 36 of module 4. Sleeve 30 includes a central bore 38 through which the shaft 40 of a screw 42 passes. Screw 42 passes through attachment portion 26 of leg 24 and pivotally mounts handle 14 to module 4. A nut 46 and a washer 48 are mounted to the threaded outer end of shaft 40 to secure screw 42 within central bore 38 of elastomeric sleeve 30.

Attachment portion 26 includes a generally V-shaped latching surface 50 positioned to engage pivot post 16 as module 4 is moved into housing 6. As suggested in FIGS. 1, 2 and 4A–4C, handle 14 is pivoted from its insertion/retraction rotary position of FIG. 1 to the locked rotary position of FIG. 2 by pivoting gripping portion 22 downwardly in the direction of arrow 51.

Figure 4A:
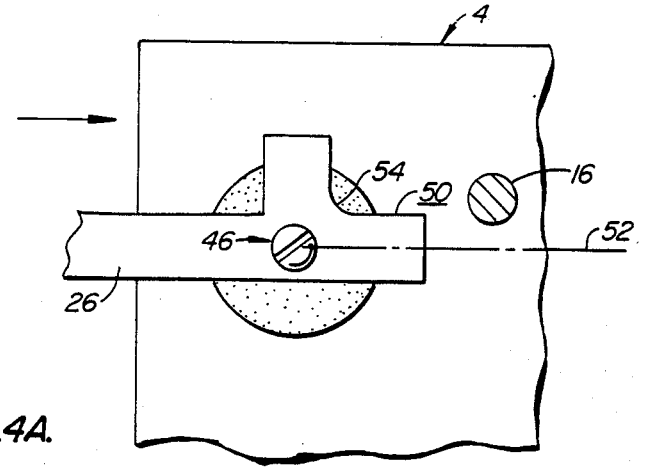
FIGS. 4A, 4B and 4C are enlarged side views of the pivot mount as it moves from the withdrawn position of FIG. 1 to the fully inserted position of FIG. 2, showing the pivot mount at a maximum deflection at the intermediate rotary position of FIG. 4B and at an intermediate deflection at the locked rotary position of FIG. 4C.
Figure 4B:
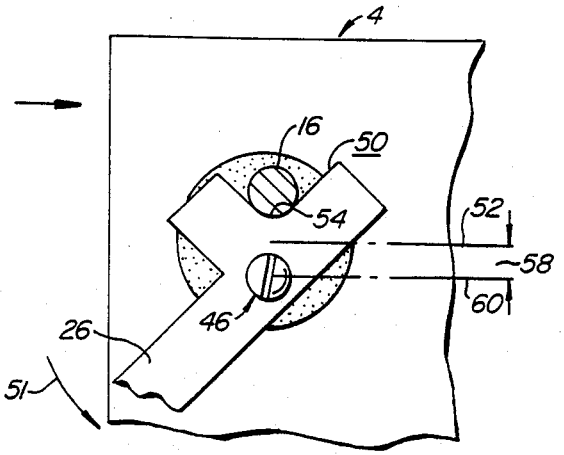
Figure 4C:
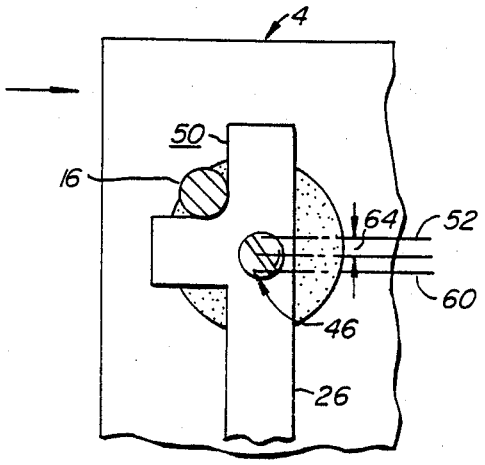

This occurs during the final sliding movement of module 4 into housing 6 as suggested in FIGS. 4A–4C. Just before engagement of latching surface 50 with pivot post 16, see FIG. 4A, the pivot axis of shaft 40 is at a first level 52. Continued movement of module 4 into housing 6 causes pivot post 16 to engage surface 50 until pivot post 22 is seated at the base 54 of surface 50. At that point further movement of module 4 into housing 6 is achieved by pivoting handle 14 downwardly in the direction of arrow 51. Because the relative vertical positions of module 4 and post 16 are substantially fixed, this causes the pivot axis of shaft 40 to be deflected downwardly a first distance 58 to a second level 60. See FIG. 4B. Further movement of module 4 to the right permits screw 46 to move upwardly to a third level 62, third level 62 being a second distance 64 below first level 52. This corresponds to the locked rotary position of handle 14 when module 4 is in the fully inserted position of FIG. 2. When in such position, movement of handle 14 upwardly, that is in the direction of arrow 66 of FIG. 2, is resisted because not only would handle 14 need to be raised against the force of gravity, shaft 40 would need to compress elastomeric sleeve 30 as it moves from the locked rotary position of FIG. 4C to the intermediate rotary position of FIG. 4B.

Starting with electronic module 4 external of housing 6 as shown in FIG. 1, the user places handle 14 in the insertion/retraction rotary position of FIG. 1 and FIG. 4A and inserts module 4 into interior 8 of housing 6 until pivot posts 16 engage face 54 of latching surface 50. This commonly occurs just as connectors 10, 12 begin to engage one another. The user then pushes inwardly on handle 14 while pivoting the handle downwardly in the direction of arrow 51 causing module 4 to become fully inserted within interior 8 of housing 6 so to engage connectors 10, 12 and move screw 42 from the first level 52, to the second, fully deflected level 60 and back to the third, partially deflected level 62 as shown in FIGS. 4A–4C. Module 4 is thus conveniently secured within housing 6 using the invention.

Modification and variation can be made to the disclosed embodiment without departing from the subject of the invention as defined in the following claims, For example, elastomeric sleeve 30 provides a radially elastic structure in all directions. If desired other types of radially elastic members which elastically support the support shaft for movement in only a single radial direction, or a limited range of radial directions. could be used. Other shapes of latching surfaces 50 can be used. Although a pair of pivot posts 16 and latching surfaces 50 are preferred, a single set could be used as well. Although in the preferred embodiment shaft 40 is cylindrical, that need not be the case. For example, shaft 40 could be keyed to the elastomeric sleeve 30 with the elastomeric sleeve being rotatably mounted within mounting hole 32.

What is claimed is:

1. An insertion/extraction apparatus for an electronic module, the module of the type including an external support structure which can be inserted into the interior of a housing to a fully inserted position and can be withdrawn from the interior of the housing, the apparatus comprising:

a handle having a grasping portion and an attachment portion;

the external support structure including a mounting hole;

a pivot mount pivotally connecting the attachment portion of the handle to the external support structure at the mounting hole, the handle movable between an insertion/retraction rotary position and a locked rotary position;

the pivot mount including:

a radially elastic member mounted within the mounting hole and having a central bore; and a support shaft extending from the attachment portion of the handle and into the central bore of the radially elastic member;

a pivot post mounted to the housing and extending into the housing interior;

the attachment portion of the handle including a latching surface positioned to engage the pivot post when the module is inserted into the housing interior towards the inserted position with the handle in the insertion/retraction rotary position, the latching surface configured to drive the module towards the fully inserted position as the handle is rotated towards the locked rotary position;

the pivot post positioned on one side of the support shaft when the handle is in the insertion/latching rotary position and on a reverse side of the support shaft when the handle is in the locked rotary position; and the latching surface configured and the pivot post positioned to bias the support shaft against the radially elastic member when the handle is at a rotary position intermediate of the insert/retraction rotary position and the locked rotar position.

2. The apparatus of claim 1 wherein the handle is U-shaped with a central grasping portion and a pair of legs with pivot mounts at each of the legs.

3. The apparatus of claim 1 wherein the radially elastic member includes an elastomeric sleeve.

4. The apparatus of claim 1 wherein the latching surface is generally V-shaped.

5. An insertion/extraction apparatus for inserting an electronic module into and retracting the electronic module from the interior of a housing, the apparatus comprising:

a handle including a grasping portion and an attachment portion, the handle movable between an insertion/retraction rotary position and a locked rotary position with an intermediate rotary position therebetween;

mounting means for pivotally mounting the attachment position to the module for pivotal movement of the handle about a handle pivot axis;

the mounting means including resilient means for radially biasing the handle pivot axis towards a first position, the first position corresponding to the insertion/retraction rotary position of the handle;

the housing including a latch surface;

the attachment portion including means for engaging the latch surface, as the handle is moved between the insertion/retraction rotary position and the locked rotary position, to drive the module into and out of the housing; and the engaging means being positioned and the latch surface configured to force the attachment portion of the handle against the resilient means so that handle pivot axis is positioned a first distance from the first position when the handle is at the intermediate rotary position and the handle pivot axis is positioned a second distance from the first position when the handle is at the locked rotary position, the second distance being less than the first distance.

6. An insertion/extraction apparatus for inserting an electronic module into and retracting the electronic module from the interior of a housing, the apparatus comprising:

a handle including a gripping portion and an attachment portion, the handle movable between an insertion/retraction rotary position and a locked rotary position with an intermediate rotary position therebetween, the attachment portion having a handle pivot, the handle pivot including a pivot axis;

mounting means for pivotally mounting the attachment portion to the module for pivotal movement of the handle about the pivot axis;

the mounting means including resilient means for radially biasing the handle pivot towards a first position, corresponding to the insertion/retraction rotary position of the handle, the handle pivot being movable relative to the module as the handle moves between the insertion/retraction rotary position and the locked rotary position;

the housing including a latching surface;

the attachment portion including means for engaging the latching surface, as the handle is moved between the insertion/retraction rotary position and the locked rotary position, the drive the module into and out of the housing; and the engaging means being positioned and the latching surface configured to move the handle pivot a first distance against the resilient means as the handle is moved between the insertion/retraction rotary position and the locked rotary position.

* * * * *